US011607619B2

(12) United States Patent
McCormick

(10) Patent No.: US 11,607,619 B2
(45) Date of Patent: Mar. 21, 2023

(54) RIDE EVACUATION SYSTEMS AND METHODS

(71) Applicant: Universal City Studios LLC, Universal City, CA (US)

(72) Inventor: Dennis McCormick, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 640 days.

(21) Appl. No.: 16/533,766

(22) Filed: Aug. 6, 2019

(65) Prior Publication Data

US 2020/0101390 A1 Apr. 2, 2020

Related U.S. Application Data

(60) Provisional application No. 62/740,216, filed on Oct. 2, 2018.

(51) Int. Cl.

| | |
|---|---|
| ***A63G 7/00*** | (2006.01) |
| ***A63G 21/20*** | (2006.01) |
| ***A63G 21/04*** | (2006.01) |

(52) U.S. Cl.

CPC ..... *A63G 7/00* (2013.01); *A63G 21/04* (2013.01); *A63G 21/20* (2013.01)

(58) Field of Classification Search

CPC ..... A63G 7/00; A63G 21/04; A63G 21/20
USPC ..... 104/31, 30, 53, 28; 182/131, 223, 63.1
See application file for complete search history.

(56) References Cited

U.S. PATENT DOCUMENTS

| | | | | |
|---|---|---|---|---|
| 3,072,217 | A * | 1/1963 | Hiyama | A01D 46/20 182/69.6 |
| 3,096,848 | A * | 7/1963 | Hiyama | A01D 46/20 182/63.1 |
| 3,129,786 | A * | 4/1964 | Hiyama | A01D 46/20 182/63.1 |
| 3,191,717 | A * | 6/1965 | Hiyama | B66F 11/04 182/63.1 |
| 3,311,191 | A * | 3/1967 | Hiyama | A01D 46/20 182/63.1 |
| 6,352,034 | B1 | 3/2002 | Bolliger et al. | |
| 2002/0185569 | A1 | 12/2002 | Henne | |
| 2007/0199474 | A1* | 8/2007 | Zamperla | A63G 7/00 104/53 |
| 2010/0066111 | A1 | 3/2010 | Fritsche et al. | |
| 2011/0061558 | A1 | 3/2011 | Crawford et al. | |

(Continued)

FOREIGN PATENT DOCUMENTS

| | | |
|---|---|---|
| CN | 107351844 A | 11/2017 |
| EP | 1721647 | 11/2006 |
| EP | 2301637 A2 | 3/2011 |

OTHER PUBLICATIONS

PCT/US2019/052702 Invitation to pay additional fees dated Nov. 26, 2019.

(Continued)

*Primary Examiner* — Zachary L Kuhfuss
(74) *Attorney, Agent, or Firm* — Fletcher Yoder, P.C.

(57) ABSTRACT

A ride system for an amusement park includes a ride vehicle configured to carry one or more passengers. The ride system further includes a first evacuation platform comprising a first section configured to be moved and disposed underneath the ride vehicle, wherein in use, the one or more passengers evacuate the ride vehicle by exiting onto the first section.

20 Claims, 14 Drawing Sheets

(56) References Cited

U.S. PATENT DOCUMENTS

| | | | | |
|---|---|---|---|---|
| 2011/0132224 | A1 | 6/2011 | Kitchen | |
| 2012/0277008 | A1* | 11/2012 | Kitchen | A63G 27/02 104/55 |
| 2015/0087431 | A1 | 3/2015 | Jackson | |
| 2017/0246484 | A1* | 8/2017 | Beutler | A63G 7/00 |
| 2018/0085968 | A1* | 3/2018 | Schilke | B27M 3/00 |

OTHER PUBLICATIONS

CN Office Action for Chinese Application No. 201980064728.1 dated Oct. 10, 2022.

* cited by examiner

RIDE EVACUATION SYSTEMS AND METHODS

CROSS-REFERENCE TO RELATED APPLICATION

This application claims priority to and the benefit of U.S. Provisional Application No. 62/740,216 entitled "RIDE EVACUATION SYSTEMS AND METHODS," filed Oct. 2, 2018, which is hereby incorporated by reference in its entirety for all purposes.

BACKGROUND

The present disclosure relates generally to the field of amusement park rides. More specifically, embodiments of the present disclosure relate to ride evacuation systems and methods for amusement park rides.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks include a variety of features providing unique experiences to each park guest. Some features may include a ride vehicle that may travel along a specific path. The path may include elements such that as the ride vehicle travels along the path, those elements may enhance a guest's experience. An evacuation system may be used to evacuate the park guest from the ride vehicle during the park ride. It may be beneficial to improve evacuation systems.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a ride system for an amusement park includes a ride vehicle configured to seat one or more passengers. The ride system further includes an evacuation platform comprising a first section configured to be moved and disposed underneath the ride vehicle, wherein in use, the one or more passengers evacuate the ride vehicle by exiting onto the first section.

In another embodiment, a method of evacuating a ride vehicle in an amusement park ride includes directing an evacuation platform to position the evacuation platform so that a first section of the evacuation platform is disposed under a ride vehicle, wherein in use, the one or more passengers evacuate the ride vehicle by exiting onto the first section. The method further includes evacuating the passengers via the evacuation platform.

In another embodiment, an evacuation platform includes a propulsion system configured to move the evacuation platform through an amusement park ride. The evacuation platform further includes a first section configured to be moved and disposed underneath a ride vehicle of the amusement park ride, wherein in use, one or more passengers evacuate the ride vehicle by exiting onto the first section.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain ride vehicles may provide park guests with a ride position that provides an enhanced ride experience, for example, when the guests are seated or otherwise suspended under a ride track. As the guests are moved along the ride track, the guests may experience enhanced visibility and improved interaction with a ride environment. In some cases, a ride vehicle carrying the guests may experience an unplanned stoppage during the ride. Embodiments of the present disclosure are directed to evacuation systems that include a movable evacuation platform, an evacuation catwalk, or a combination thereof. The movable evacuation platform may be positioned to enable the guests to evacuate the ride vehicle and exit onto the movable evacuation platform. The guests may then traverse the movable evacuation platform onto the evacuation catwalk and subsequently leave the attraction.

In certain embodiments, multiple movable evacuation platforms may be provided, which may link or abut against each other, providing for an enhanced walkway for the guests. Additionally, the multiple movable evacuation platforms may be used during standard embarkation and disembarkation of guests, for example, at a guest ride entrance area, thus providing for double functions as a standard operations platform and an evacuation platform. Indeed, one or more of the moveable evacuation platforms may be stationed at the guest ride entrance area and used both for standard embarkation/disembarkation as well as for the evacuation of guests during ride stoppages. By providing for the techniques described herein, more efficient and improved evacuation of ride guests may be achieved.

Figure 1:
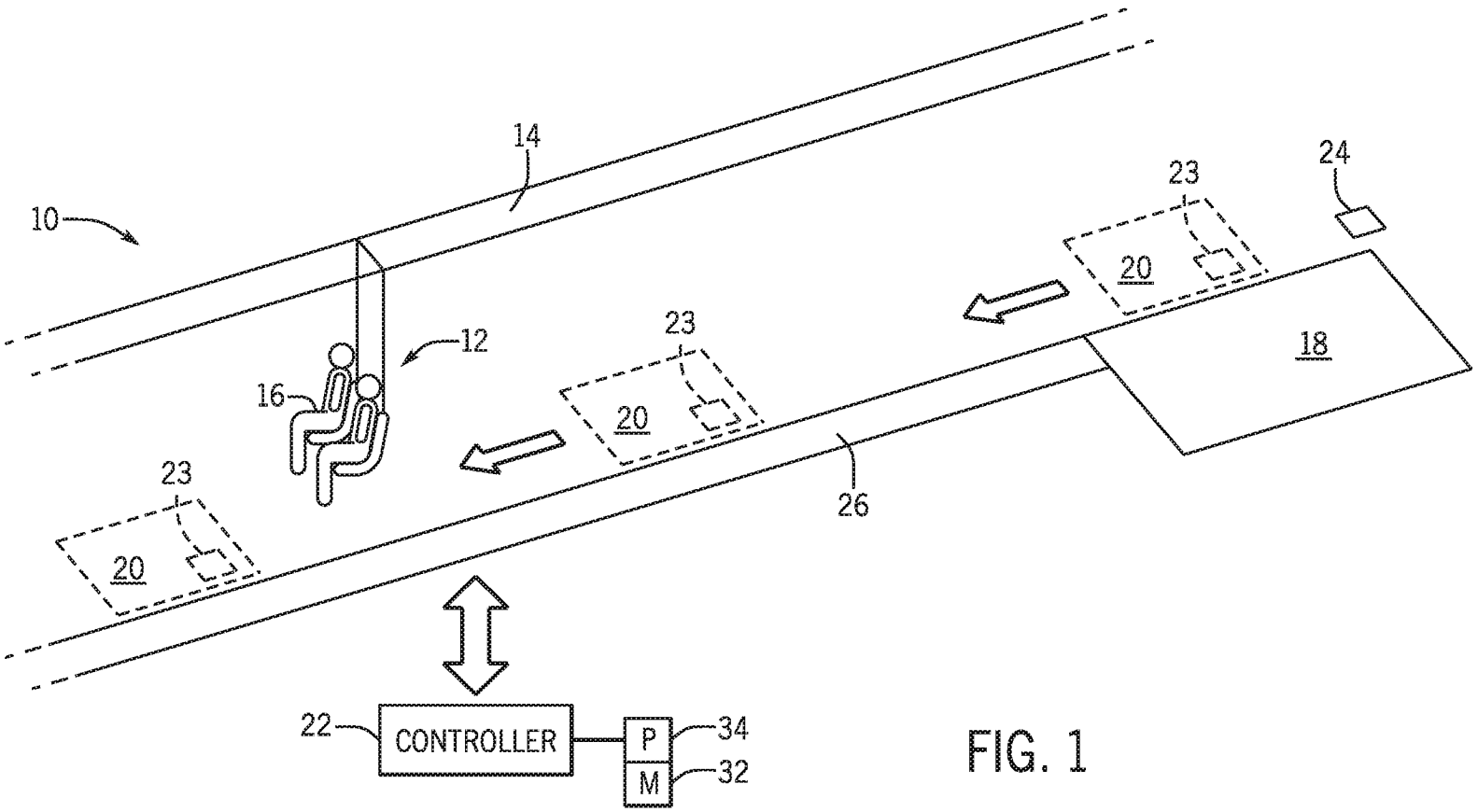
FIG. 1 is a block view of an embodiment of a ride system that includes an evacuation platform and an evacuation catwalk, in accordance with an aspect of the present disclosure.

Turning now to the drawings, FIG. 1 is a block view of an embodiment of a ride system 10 that may be located in an amusement park. As illustrated in FIG. 1, the ride system 10 includes ride vehicles 12, for example, that provide for a suspended ride position under a rail system 14 (e.g., track-rail system) while enjoying the amusement ride. Park guests 16 may enter the ride 10 at an embarkation area 18, which may also be used for disembarkation of the guests 16 at the end of the ride. To enter the ride vehicle 12, a movable evacuation platform 20 may be used as part of the embarkation process, or may be parked in the vicinity of the embarkation area 18. Once the guests 16 are secured in the ride vehicle 12, the ride vehicle 12 may traverse through the ride via the rail system 14. At the end of the ride, the ride vehicle 12 may position the guests 16 onto the embarkation area 18 for disembarkation.

In some cases, an unplanned ride stoppage may occur. It may therefore be desired to evacuate the guests 16 from any location in the ride where the ride vehicles 12 may be currently stopped. Accordingly, a controller system 22 may be operatively coupled to the one or more of the moveable evacuation platforms 20 and direct one or more of the moveable evacuation platforms 20 towards the ride vehicles 12. The controller system 22 may additionally control the ride vehicle 12 and or other systems in a ride having the ride vehicle 12. The controller system 22 may be disposed outside of the evacuation platform 20 or in the evacuation platform 20. The moveable evacuation platforms 20 may include one or more internal motors 23 such as electric motors (e.g., battery-powered electric motors), combustion engines, and so on, suitable for providing a motive force to their respective moveable evacuation platform 20.

External motor(s) 24 may alternatively or additionally be used to move the moveable evacuation platform(s) 20. For example, redundant drive motors 24 and a pushbutton-control-box may be stationary, and located at both ends of a conventional/recirculating-loop of chain/timing-belt/cable. This arrangement of using external motor(s) 24 may eliminate the following onboard hardware & controls: Onboard batteries [(2) redundant], Battery charging system with connectors/cables, Onboard motors [(2) redundant], Onboard gearboxes [(2) redundant], Onboard control system [(2) redundant] with wiring and human machine interface (HMI) [(1) redundant], booster-wheel propulsion [(2) redundant], compliant pressure-loaded pinch arrangements [(2) redundant—along guide rails for booster wheels], onboard variable drives (VFDs) [(2) redundant], onboard communication systems [(2) redundant] linked with matched/dedicated handheld RCU], handheld RCUs [(2) redundant], locking brakes [(2) redundant] to secure shuttle to guiderails, docking/locking brakes [(2) redundant] to secure platform 20 in parked position, weight/mounting of above equipment may use a more robust platform 20 design (further increasing platform weight), higher related maintenance expenses/labor savings for the above hardware/controls.

In certain embodiments, the moveable evacuation platform 20 may be moved and parked at a location under the ride vehicle 12, suitable for providing for a dismount platform for the guests 16 as further described below. The guest(s) 16 may then unfasten any restraint systems (e.g., belts, lap bars, harnesses, and so on) and dismount the ride vehicle 12, stepping onto the evacuation platform 20. The moveable evacuation platform 20 may support the weight of the guests 16 and provide a walkway or "bridge" for the guests 16 to transition onto an evacuation catwalk 26. The evacuation catwalk 26 may provide for a passenger conduit to exit onto evacuation areas and/or back onto the disembarkation area. Further, multiple moveable evacuation platforms 20 may be disposed abutting each other, for example, end-to-end as further described below, to provide for a longer evacuation platform.

The control system 22 may be located within the ride 10, or may be located outside of the ride 10, possibly as a hand-held remote-control unit. The control system 22 may include a memory (M) 32 with stored instructions for controlling either or both the ride vehicle 12 and the movable evacuation platforms 20. In addition, the control system 22 may include a processor (P) 34 configured to execute such instructions. For example, the processor 34 may include one or more application-specific integrated circuits (ASICs), one or more field-programmable gate arrays (FPGAs), one or more general purpose processors, or any combination thereof. Additionally, the memory 32 may include volatile memory, such as random access memory (RAM), and/or non-volatile memory, such as read-only memory (ROM), optical drives, hard disc drives, or solid-state drives.

Figure 2:
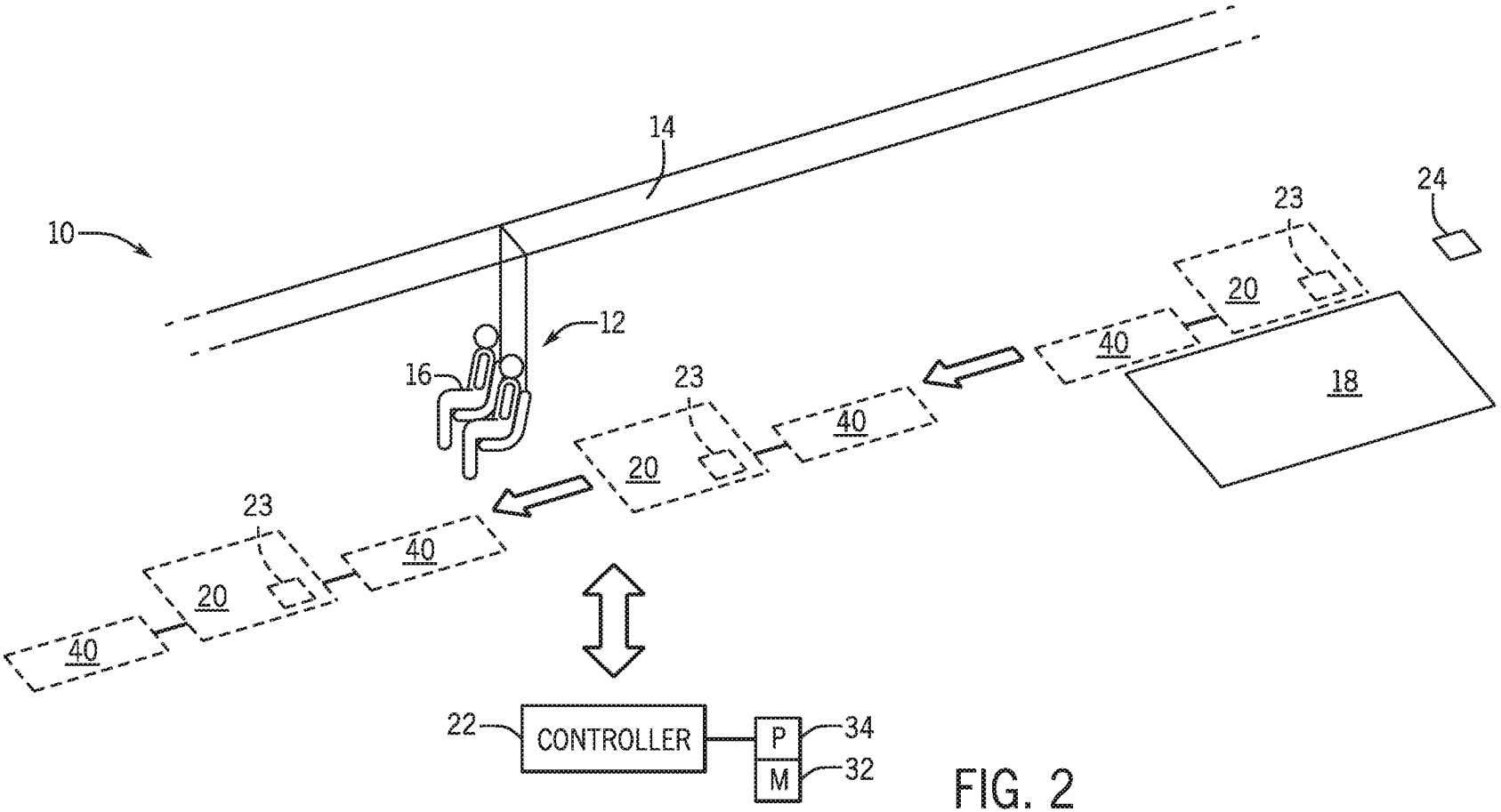
FIG. 2 is a block view of an embodiment of the ride system of FIG. 1 that includes an evacuation platform and an evacuation shuttle, in accordance with an aspect of the present disclosure.

FIG. 2 is a block view of an embodiment of the ride system 10 that replaces the evacuation catwalk 26 with one or more evacuation shuttles 40. More specifically, the evacuation shuttle 40 may be mechanically coupled to the evacuation platform 20 so that the evacuation platform 20 and the evacuation shuttle 40 may traverse the ride in tandem to arrive at the ride vehicle 12. Once at the location of the ride vehicle 12, the passengers 16 may disembark into the evacuation shuttle 40 via the evacuation platform 20. More specifically, the evacuation platform 20 may act as a staging platform to offload and then transfer one or more passengers 16 from the ride vehicle 12 into the evacuation shuttle 40. The evacuation shuttle 40 may then transport the passengers 16 to a disembarkation area, such as the embarkation area 18.

Motive power for the evacuation shuttle 40 may be provided by the evacuation platform 20, by a motor (e.g., battery powered electric motor, internal combustion engine, and so on) internal to the evacuation shuttle 40, and/or by an external motor. In certain embodiments, the evacuation shuttle 40 may proceed under its own power or under external power separate from the evacuation platform 20. In other embodiments, the evacuation shuttle 40 may be towed or pushed by the evacuation platform 20 to the selected evacuation area. The control system 22 may be operatively coupled to the evacuation shuttle 40 and thus control the evacuation shuttle 40 and/or the evacuation platform 20 to retrieve the passengers from the ride vehicle 12.

The evacuation shuttle 40 may be mechanically coupled to a forward section of the evacuation platform 20, to a rear or aft section of the evacuation platform 20, to a side of the evacuation platform 20, or a combination thereof. Further, multiple evacuation shuttles 40 may be positioned as a train to be ferried by one or more of the evacuation shuttles 40. In the depicted embodiment, the removal of the evacuation catwalk 26 may provide for enhanced spacing for the ride system 10, as well as reduced construction and equipment maintenance. Further, the evacuation platform 20 may be used for maintenance, as described below.

Figure 3:
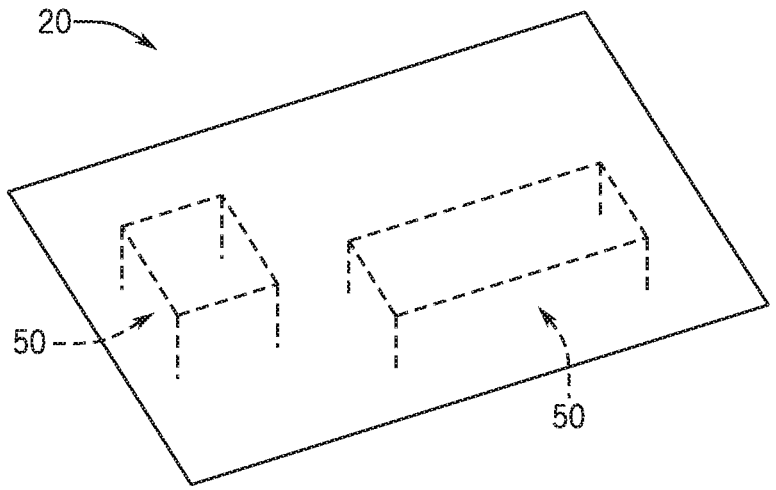
FIG. 3 is a block view of an embodiment of the evacuation platform of FIGS. 1 and 2 having one or more scaffolds, in accordance with an aspect of the present disclosure.

FIG. 3 is a block view of an embodiment of the evacuation platform 20 having one or more scaffolds 50 useful, for example, in providing for raised support during maintenance operations. For example, maintenance personnel may climb onto the scaffold(s) 50 when raised to work on track-rails, ride vehicles, ride columns, and other components of the amusement ride 10. In certain embodiments, the raised scaffold(s) 50 may fold and tuck inside of the evacuation platform 20. For example, the raised scaffold(s) 50 may include telescoping embodiments, folding embodiments, hand removable and replaceable embodiments, and the like, that enable the raised scaffold(s) 50 to be stored, for example, in compartments of the evacuation platform 20 so that during transport the raised scaffold(s) 50 may be stowed in a manner that does not affect travel of the evacuation platform 20. Once the evacuation platform 20 reaches a desired destination for maintenance, the one or more raised scaffolds 50 may then be deployed and used. Once the maintenance work is completed, the scaffolds 50 may then be stowed and the evacuation platform 20 may be used to convey the maintenance personnel to another desired location.

Figure 4:
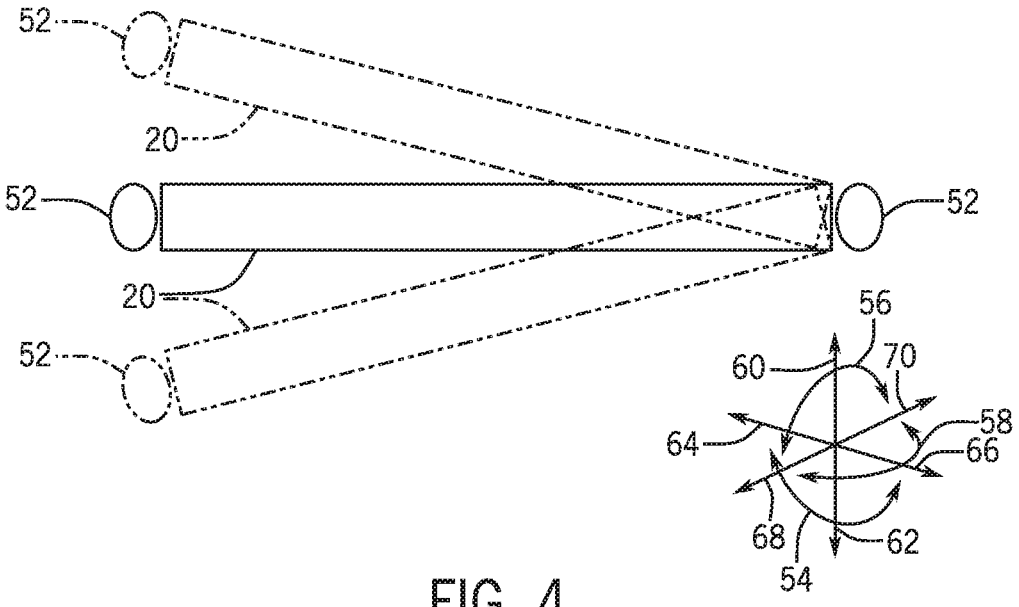
FIG. 4 is front view of an embodiment of the evacuation platform of FIGS. 1 and 2 coupled to one or more guiderails of a section of track, in accordance with an aspect of the present disclosure.

As the evacuation platform 20 traverses the ride 10 towards a desired destination, the evacuation platform 20 may follow one or more guiderails 52, as shown in FIG. 4. More specifically, the figure is a front perspective view illustrating the evacuation platform 20 at various angles that may be used during movement of the evacuation platform 20 to its destination. Indeed, the evacuation platform 20 may follow the guiderails 52, for example, to achieve six degrees of freedom (i.e., pitch 54, roll 56, yaw 58, up 60, down 62, left 64, right, 66, forward 68, and back 70). In addition to or alternative to following the guiderail(s) 52, the evacuation platform 20 may include actuators that enable the evacuation platform 20 to also achieve the six degrees of freedom, for example, when attached to a single guiderail 52 or dual parallel guiderails. The actuators may include mechanical actuators, pneumatic actuators, electric actuators, hydraulic actuators, and the like, which may be connected to the portions of the evacuation platform 20 and/or the guide rail 52 to move the evacuation platform 20 as desired. Pucks, bogie wheels, or similar devices may be used to interface the evacuation platform 20 to the guiderails 52.

Figure 5:
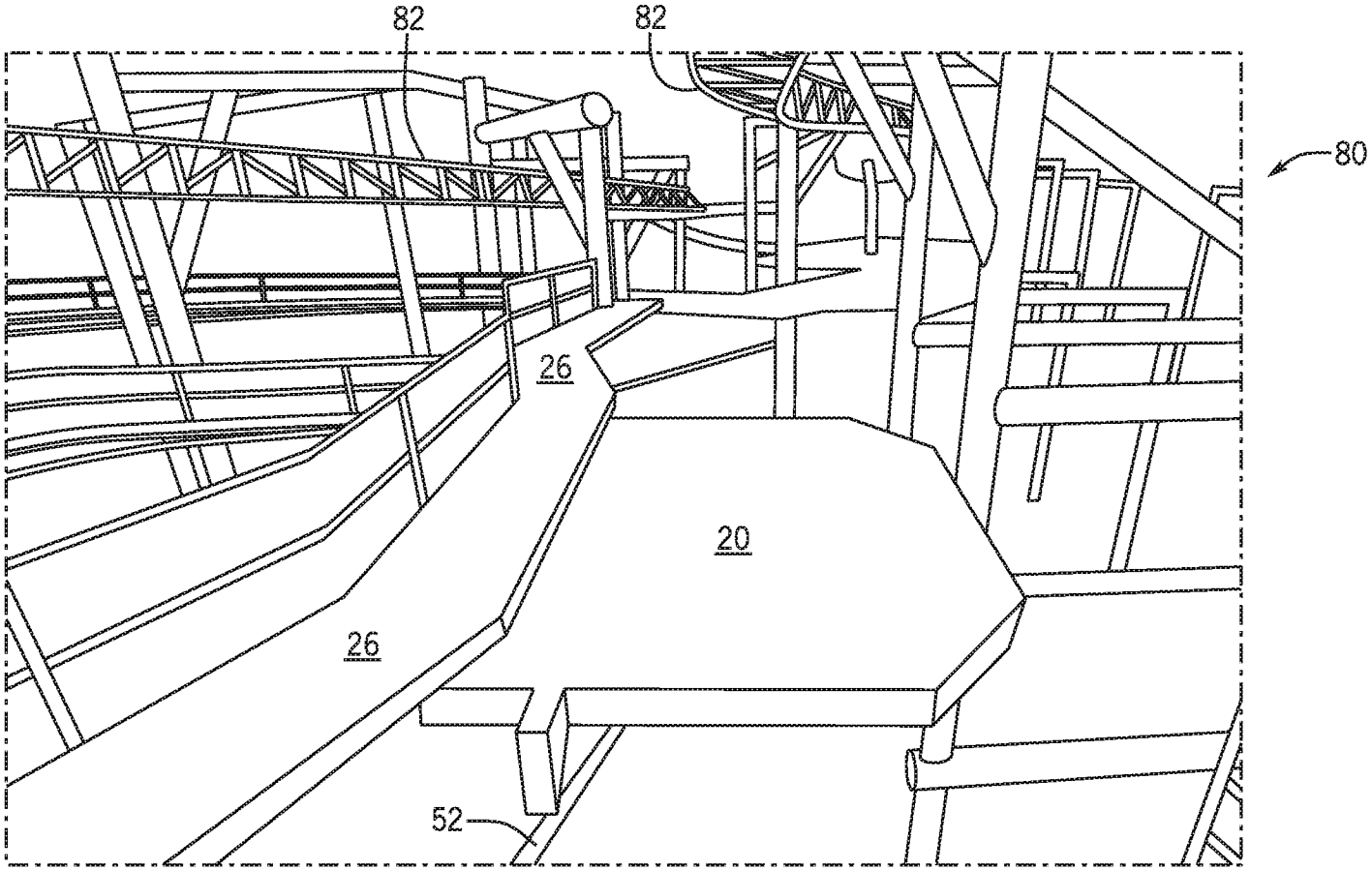
FIG. 5 is a perspective view of an embodiment of the evacuation platform and evacuation catwalk of FIG. 1 disposed on a section of track, in accordance with an aspect of the present disclosure.

FIG. 5 is a perspective view of an embodiment of a section of track 80 for the ride 10 showing the evacuation platform 20 traversing the ride 10. In the depicted embodiment, the evacuation platform 20 is shown as mechanically connected to one guiderail 52 outboard/below the catwalk and another guiderail 52 directly under the catwalk (not shown). The guiderail 52 may follow or otherwise parallel the evacuation catwalk 26 and be disposed with certain portions of the evacuation platform 20 below the evacuation catwalk. In turn, the evacuation catwalk 26 may follow the contours of a rail system 82 so that guests may be more easily evacuated. For example, the guiderail 52 may be disposed to follow the same profile geometry (e.g., straights, curves, bends) of the rail system 82 thus enabling the moveable evacuation platform 20 to reach any point that may be reached by the ride vehicles 12.

Additionally or alternatively, the evacuation catwalk 26 may be used by maintenance personnel to access certain areas of the ride 10 during maintenance and/or repair activities. Further and as mentioned earlier, in certain embodiments, the evacuation platform 20 may be used to transfer guests into the evacuation shuttle 40. In some of these embodiments, the evacuation catwalk 26 may not be used. Accordingly, the ride 10 without the evacuation catwalk 26 may provide for a more open area for guests 16 to enjoy during the vehicle's traversal. Further, the ride 10 may be constructed more efficiently, with less material, and with reduced costs.

Figure 6:
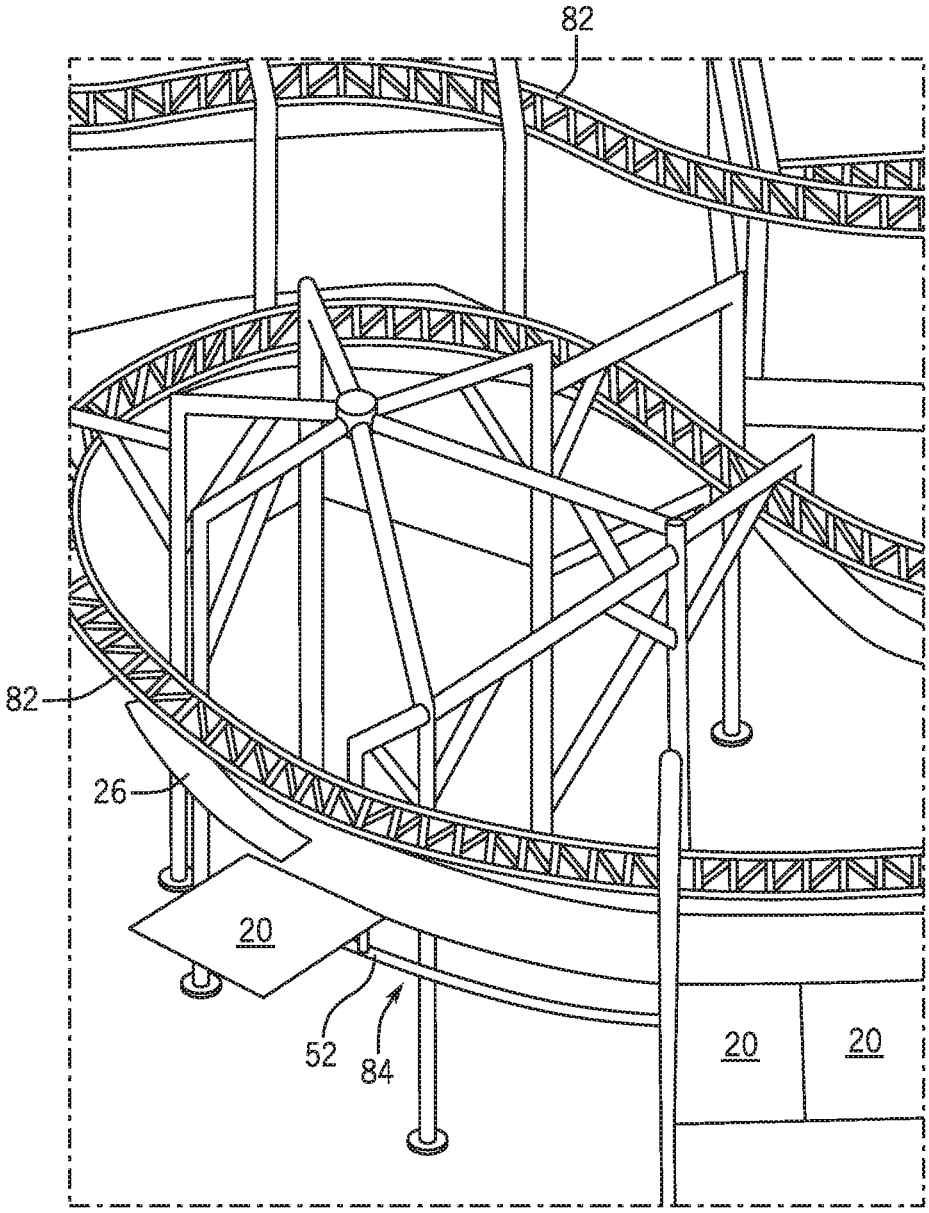
FIG. 6 is a perspective view showing embodiments of multiple evacuation platforms disposed on a section of track, in accordance with an aspect of the present disclosure.

FIG. 6 is a perspective view showing embodiments of multiple evacuation platforms 20 traversing the ride 10. As noted earlier, one or more evacuation platforms 20 may be used to provide for the evacuation of guests 16 and/or for maintenance personnel use during work activities. As illustrated, the various evacuation platforms 20 may be staged to provide for platforms of varying overall size. For example, by placing three platforms abutting against each other, one longer (e.g., triple-length) platform may be provided. Also shown is a curved section 84 of the guiderails 52 that may be traversed by the evacuation platforms 20 on their way to a desired destination. As the evacuation platform 20 traverses the guiderails 52, the evacuation platform 20 may follow curved contours (e.g., by rolling, pitching, yawing, and so on) to better traverse through the ride 10. Further, certain locations of the guiderails 52 in the ride 10 may be designated as parking locations for the one or more evacuation platforms 20.

Figure 7:
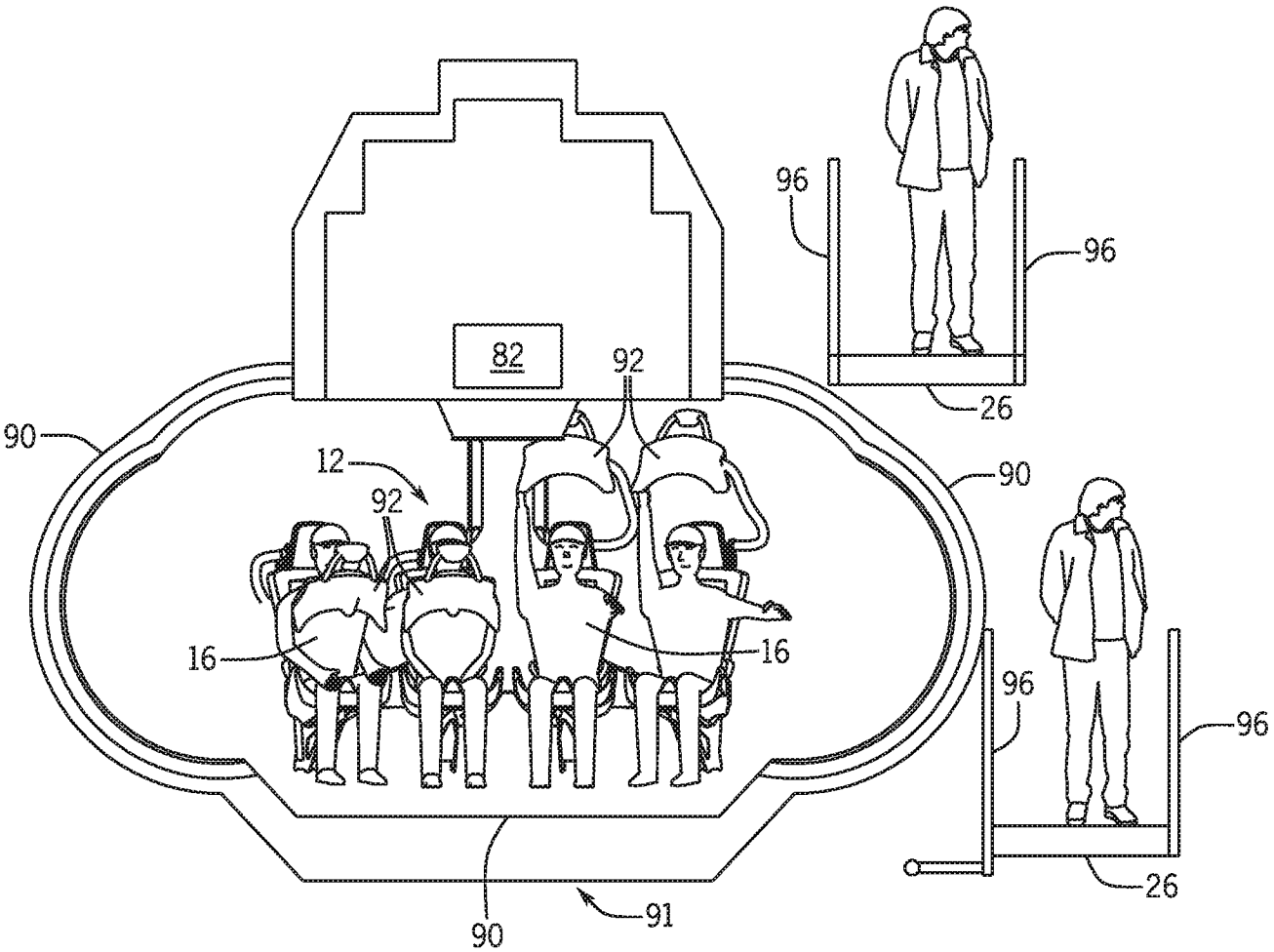
FIG. 7 is a view of an embodiment of a ride vehicle for the ride system of FIGS. 1 and 2, in accordance with an aspect of the present disclosure.

Once the evacuation platform 20 arrives at the location of the ride vehicle 12, the evacuation platform 20 may be disposed under the guest's feet in an area 91, as shown in FIG. 7. In certain embodiments, the evacuation platform 20 may be disposed outside of a reach envelope 90. That is, the reach envelope 90 may be a region surrounding the ride-restrained guest 16 such that the guest 16 may only be physically able to access locations inside of the reach envelope 90 but not outside of the reach envelope 90, for example, because of anatomical constraints such as leg length, arm length, height, and so on. That is, if the guest 16 is restrained via a ride restraint system 92 e.g., lap bar, seat belts, and the like, a restraint reach envelope 90 may be derived based on anatomical human constraints such that the evacuation platform 20 may be outside of the restraint reach envelope 90 so that the evacuation platform 20 may slide under the guest's feet.

Once the evacuation platform 20 is disposed under the guest's feet, the restraint system 92 may be unfastened and the guests 16 may then exit the ride vehicle from their ride-seats onto the evacuation platform 20. Accordingly, while the evacuation platform 20 may be outside of the guests' restraint reach envelope 90, the evacuation platform 20 may be easily accessed without having to jump or otherwise lower oneself down from the ride-seats once the restraint system is removed. Instead, the guests may simply lower their legs and stand up, then proceed onto the evacuation catwalk 26. The evacuation catwalk 26 may then be used as a walkway to leave the ride 10.

The figure also illustrates the evacuation catwalks 26 as having two handrails 96. The handrails 96 may be deployable. That is, the handrails 96 may be stowed in the evacuation catwalk 26 and then deployed during evacuation of guests or during maintenance. Accordingly, the handrails 96 may provide for additional support as the guests 16 or maintenance personnel use the evacuation catwalk 26. Also shown is a second, e.g., alternate, evacuation catwalk 26 disposed at a higher location. The second or alternate/upper evacuation catwalk 26 may be part of a different section of track and may be connected to the first evacuation catwalk 26 through, for example, stairs. The second or alternate/upper evacuation catwalk 26 may also be temporarily connected to the evacuation platform 20 through, for example, fold-down stairs.

Figure 8:
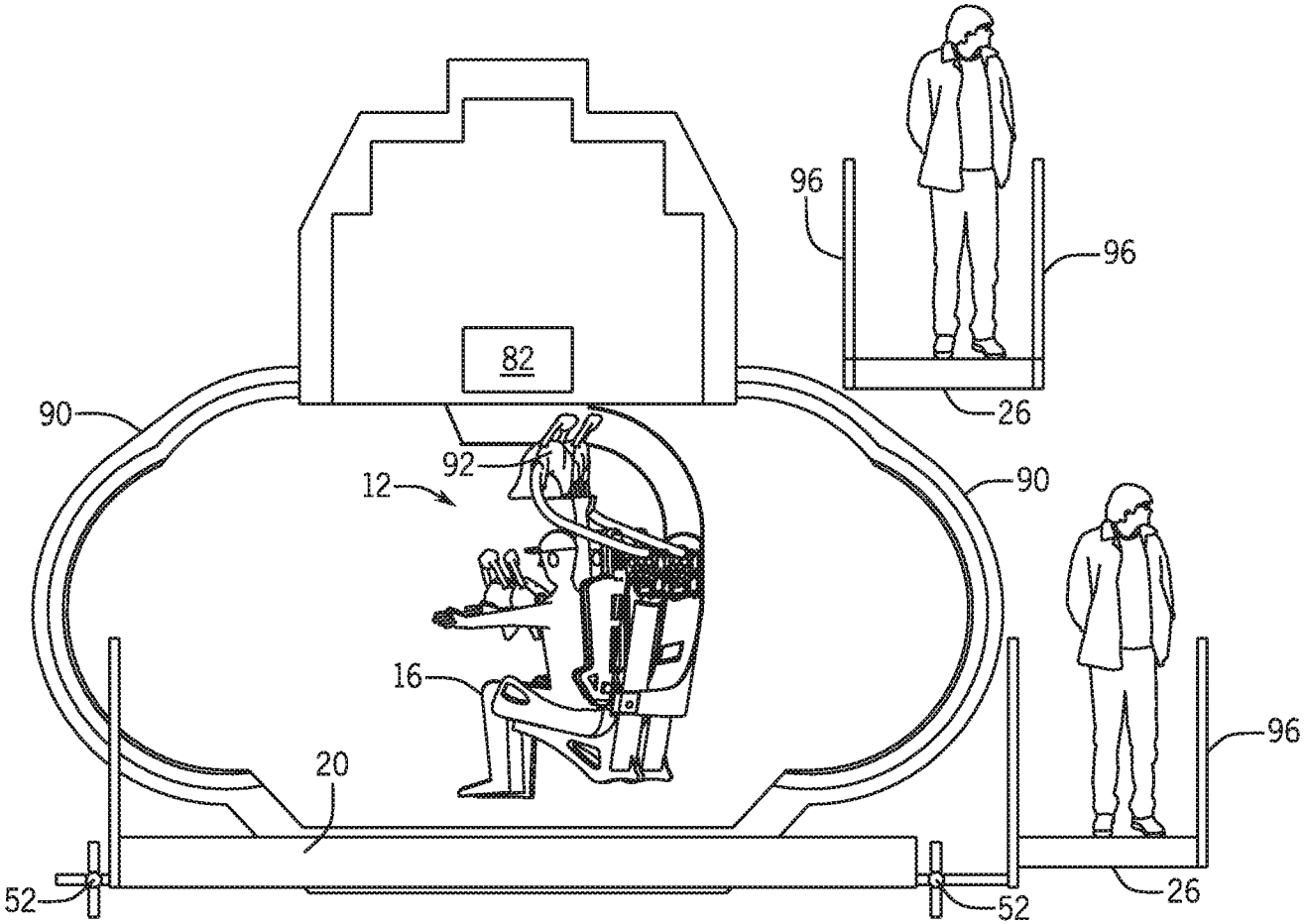
FIG. 8 is a view of an embodiment of the evacuation platform of FIGS. 1 and 2 having a first section of the evacuation platform disposed underneath a ride vehicle, in accordance with an aspect of the present disclosure.

FIG. 8 illustrates an embodiment of the evacuation platform 20 disposed under the ride vehicle 12 for evacuation of the guests 16. Because the figure illustrates the same elements as FIG. 7, the same elements are illustrated with the same element numbers. In the depicted embodiment, the evacuation platform 20 is shown as having been disposed beneath the ride vehicle 12 and below the guests 16. In use, once the evacuation platform 20 has arrived at the ride vehicle 12, restraint systems securing the guests 16 would be unlocked and the guests would then step onto the evacuation platform 20. The guests would use the evacuation platform 20 as a bridge or conduit to the evacuation catwalks 26. In certain embodiments, after all the guests 16 have been removed from the ride vehicle 12, the evacuation platform 20 may then move to another location, such as another ride vehicle 12 or another portion of a ride vehicle with multiple rows of seats (e.g. a ride vehicle having 3 gondolas with 4 seats each).

In the depicted embodiment of FIG. 8, the evacuation platform 20 is shown as connected to two guiderails 52 disposed at opposite ends of the evacuation platform 20. As mentioned earlier, the guiderails 52, and in turn the evacuation platform 20, may follow the same geometry as the tracks used to guide the ride vehicle 12, including twists, turns, banks, and so on. Accordingly, the evacuation platform 20 may be situated for easy evacuation of the guests 16. In the depicted embodiment, the evacuation catwalks 26 are also shown as outside of the reach envelope 90. However, in other embodiments, the evacuation catwalks 26 may be above the reach envelope, as shown in FIG. 8, or inside of the reach envelope 90, as show in FIG. 9.

Figure 9:
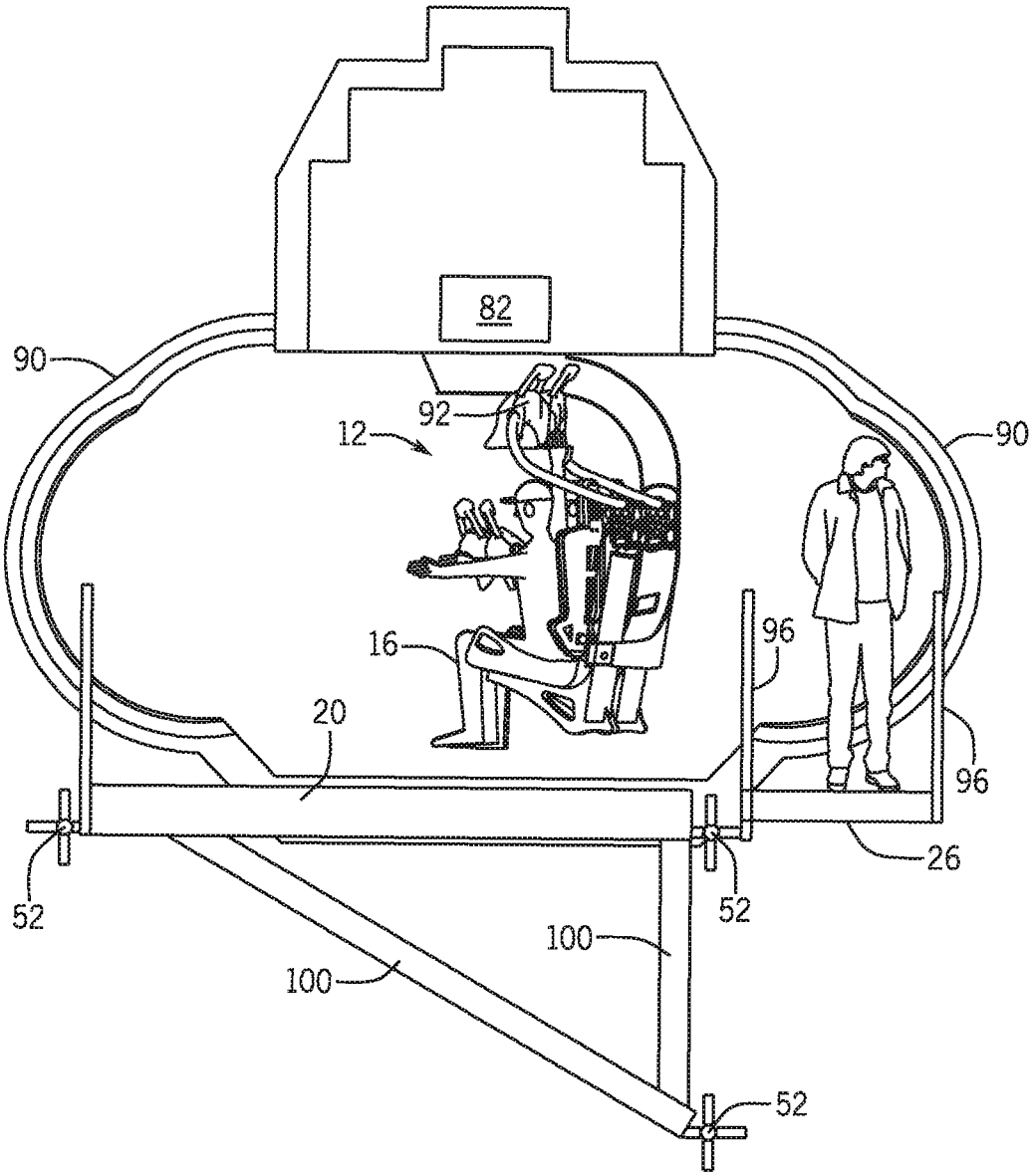
FIG. 9 is a view of an embodiment of the evacuation platform of FIGS. 1 and 2 having a first section of the evacuation platform disposed underneath a ride vehicle with an evacuation catwalk disposed inside a reach envelope of the ride vehicle, in accordance with an aspect of the present disclosure.

More specifically, FIG. 9 illustrates an embodiment of the evacuation platform 20 where the evacuation catwalk 26 is disposed inside of the reach envelope 90. As illustrated the evacuation platform 20 may be disposed proximal to the evacuation catwalk 26 and may also be coupled to two of the three shown guiderails 52—either the two horizontally-displaced guiderails 52 or the two vertically-displaced guiderails 52 (labeled stacked alternative). In the depicted embodiment, the evacuation platform 20 is a cantilevered platform. Accordingly, a cantilever assembly 100 may be used to provide mechanical coupling to the two stacked guiderails 52. The cantilevered evacuation platform 20 may support more weight when compared to other embodiments, and thus may be more suitable for rides with higher passenger capacity. The stacked arrangement of guiderails on the catwalk side avoids the visual distraction of the horizontally-displaced guiderail on the opposite side of the ride path. Also as noted above, the evacuation catwalk 26 may include deployable handrails 96 that may be stowed in the evacuation catwalk 26 until needed.

Figure 10:
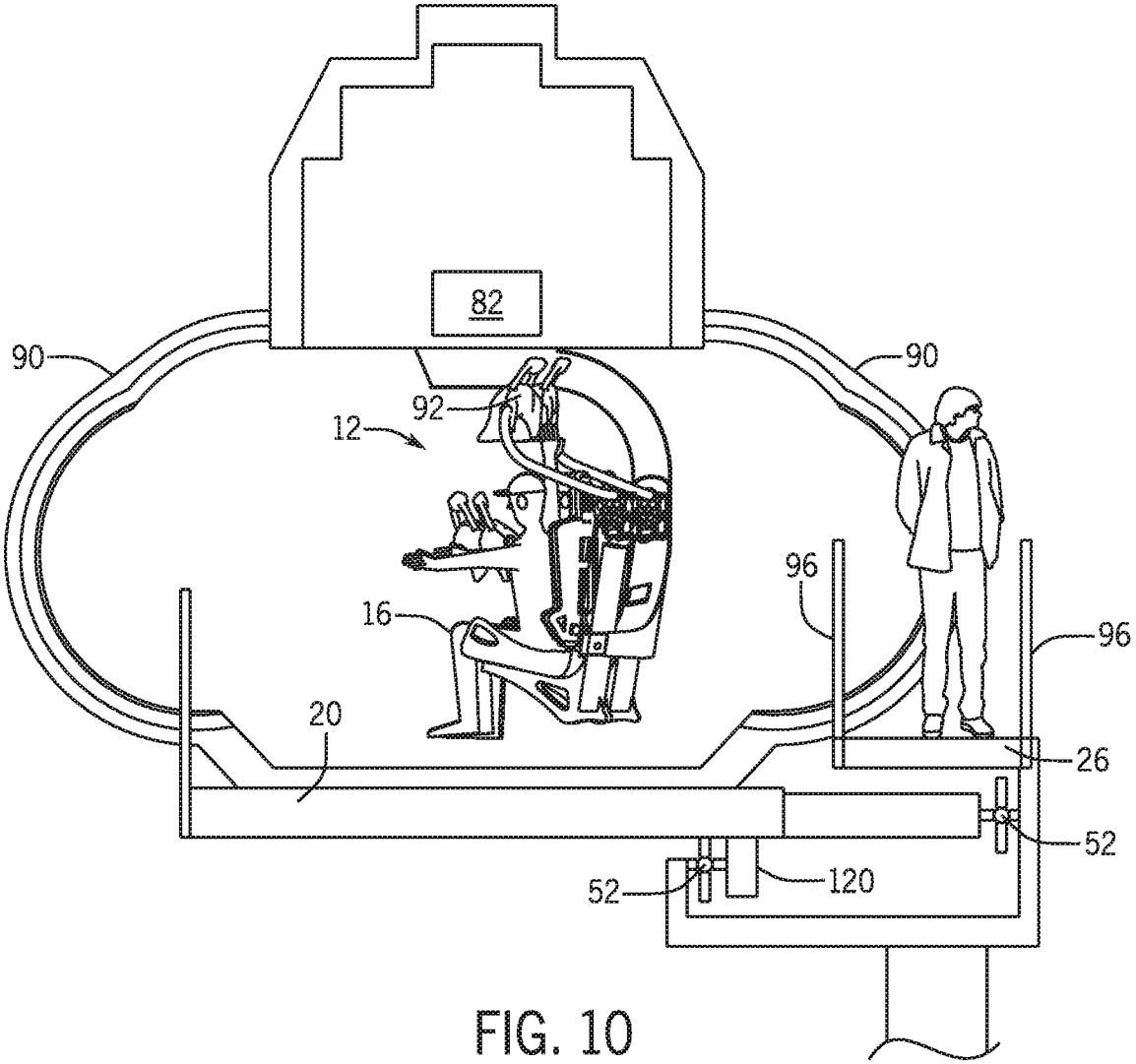
FIG. 10 is a view of another embodiment of the evacuation platform of FIGS. 1 and 2 having a first section of the evacuation platform disposed underneath a ride vehicle with an evacuation catwalk disposed inside a reach envelope of the ride vehicle, in accordance with an aspect of the present disclosure.

FIG. 10 illustrates another embodiment of the evacuation platform 20 where the evacuation catwalk 26 is disposed inside of the reach envelope 90. As illustrated, the evacuation platform 20 may be attached to two inboard guiderails 52. In use, the evacuation platform 20 may be parked with a section of the evacuation platform 20 disposed under the evacuation catwalk 26. In the depicted embodiment, the evacuation platform 20 is a dual-inboard cantilevered platform. Accordingly, a cantilevered assembly 120 may be used to provide a mechanical coupling to the two inboard guiderails 52. Both guide rails may be disposed on one end of the evacuation platform 20, as shown. Accordingly, ride visibility and ease of construction may be enhanced. Also as noted above, the evacuation catwalk 26 may include deployable handrails 96 that may be stowed in the evacuation catwalk 26 until needed.

Figure 11:
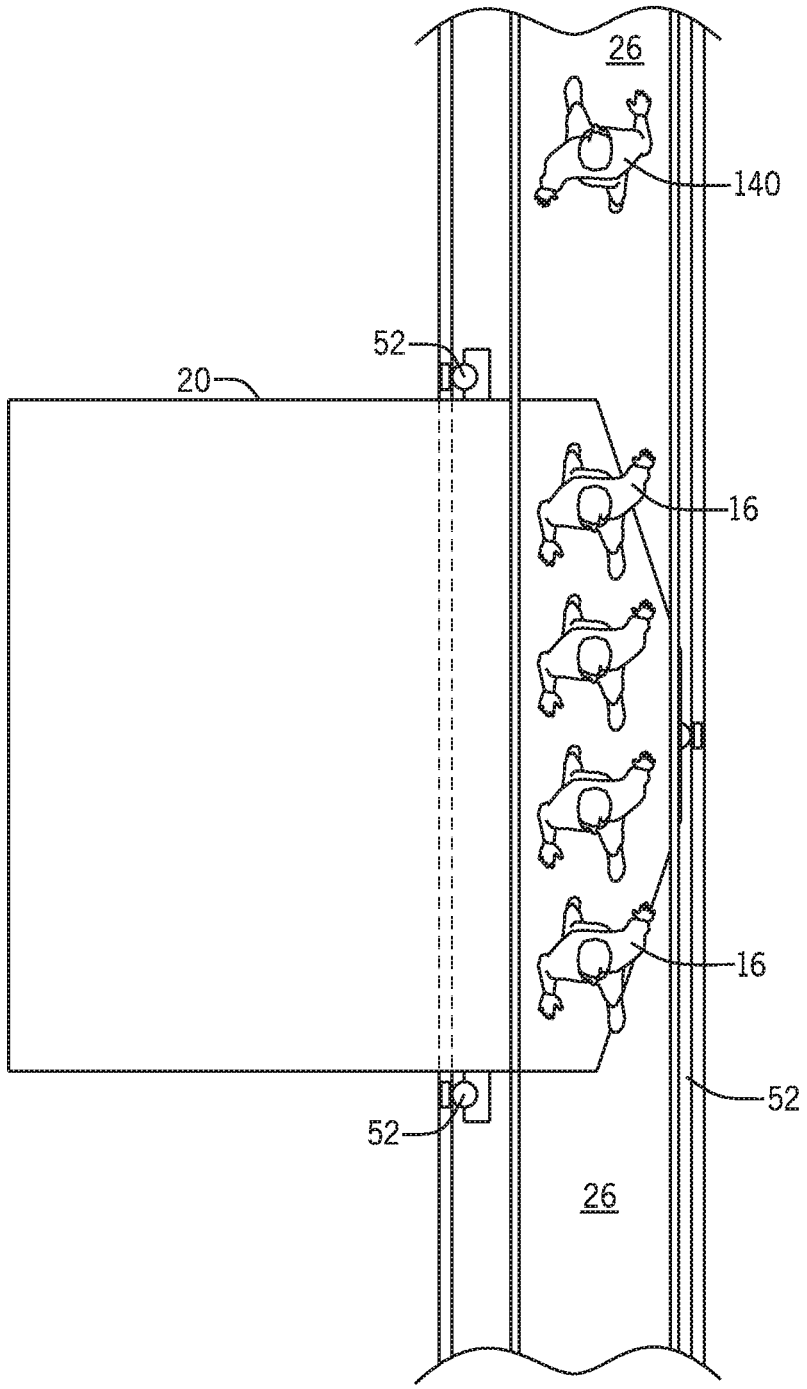
FIG. 11 is a top view of an embodiment of the evacuation platform of FIGS. 1 and 2 having a portion or second section of the evacuation platform disposed under an evacuation catwalk, in accordance with an aspect of the present disclosure.

FIG. 11 is a top view illustrating an embodiment of the evacuation platform 20 during evacuation activities. More specifically, the figure depicts the evacuation platform 20 parked under the evacuation catwalk 26. Also depicted are four guests 16 and an operator 140 walking on the evacuation catwalk 26. In the depicted embodiment the four guests 16 are walking on the evacuation catwalk 26 towards a nearest facility evacuation point while the operator 140 is shown as walking in an opposite direction on the evacuation catwalk 26 towards the next ride vehicle 12 (or next row of seats), for example to aid in that ride vehicle's (or next seat-row) evacuation. The operator 140 may direct the evacuation platform 20 to the next ride vehicle via a remote control unit (e.g., handheld, smart phone, tablet, smart watch, and so on) as needed. Also shown are guiderails 52 that may be used to provide guidance for the evacuation platform 20 along the ride path.

The evacuation platform 20 may also be used either as a shuttle itself or connected to an evacuation shuttle 40 as mentioned earlier. For example, and turning now to FIG. 12, the figure illustrates an embodiment of the evacuation platform 20 with a passenger section 160 that may be used to transport guests 16. For example, once the evacuation platform 20 is in place, the restraint system 92 may be unlocked and the guests 16 may then proceed to the passenger section 160. Guard rails and/or seats may also be deployed in the passenger section 160, suitable for improving the securement of the guests 16 during transport. Once the guests 16 are in the passenger section 160, the operator 140 may direct the evacuation platform 20 to an offloading location.

Figure 12:
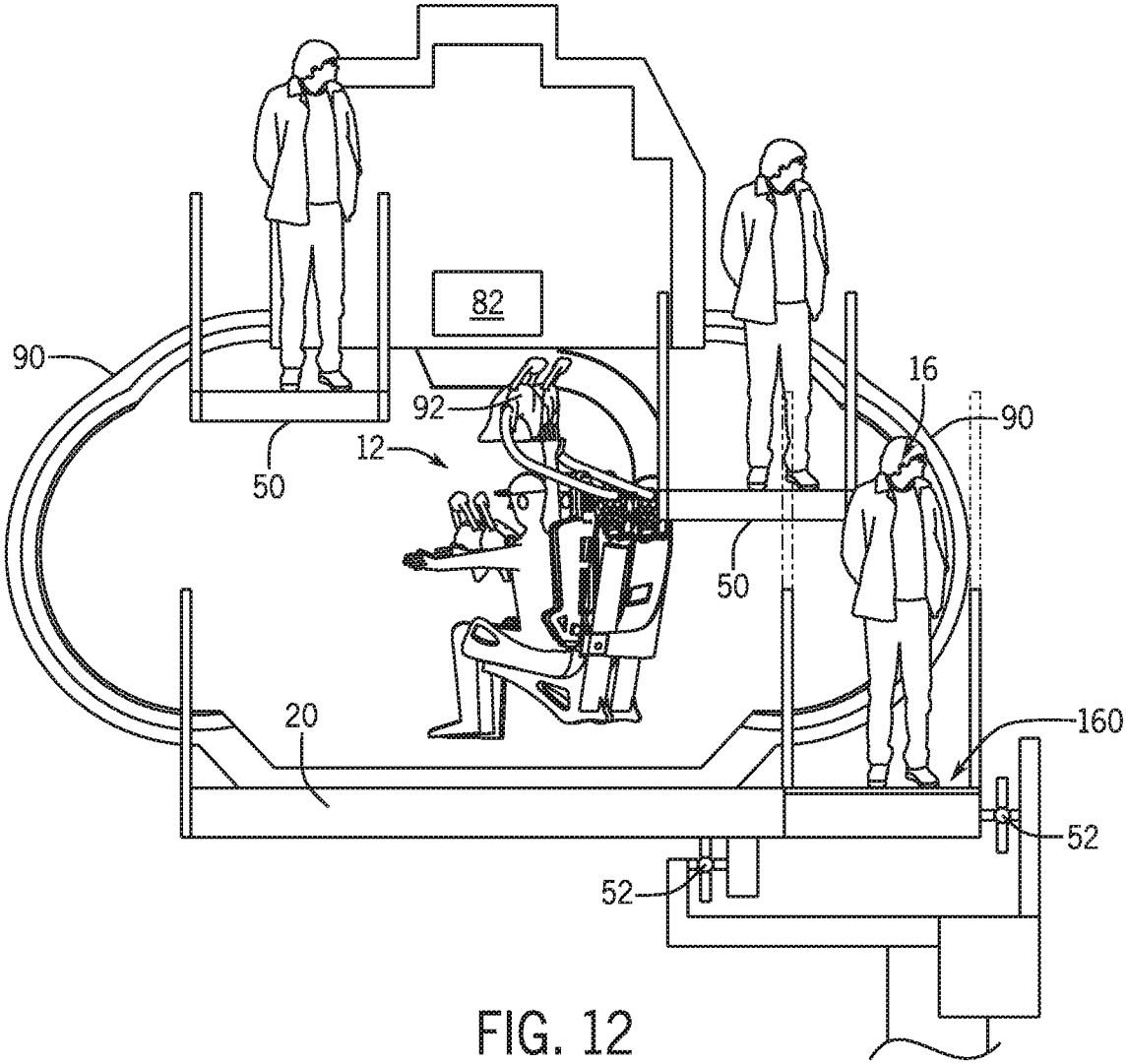
FIG. 12 is a view of an embodiment of the evacuation platform of FIGS. 1 and 2 having a first section of the evacuation platform disposed underneath a ride vehicle and a passenger standing/sitting section or portion, in accordance with an aspect of the present disclosure.

Also shown in FIG. 12 are two scaffolds 50 that may be deployed, for example, during maintenance activities. Indeed, the scaffolds 50 may be included in the evacuation platform 20, or additionally or alternatively to the passenger section 160. As mentioned earlier, one or more scaffolds that are useful for maintenance work may be carried and/or stowed in the evacuation platform 20. The scaffolds 50 may then be deployed as needed, for example to reach various locations in the ride vehicle 12, the rail system 82 the ride 10, and so on.

Figure 13:
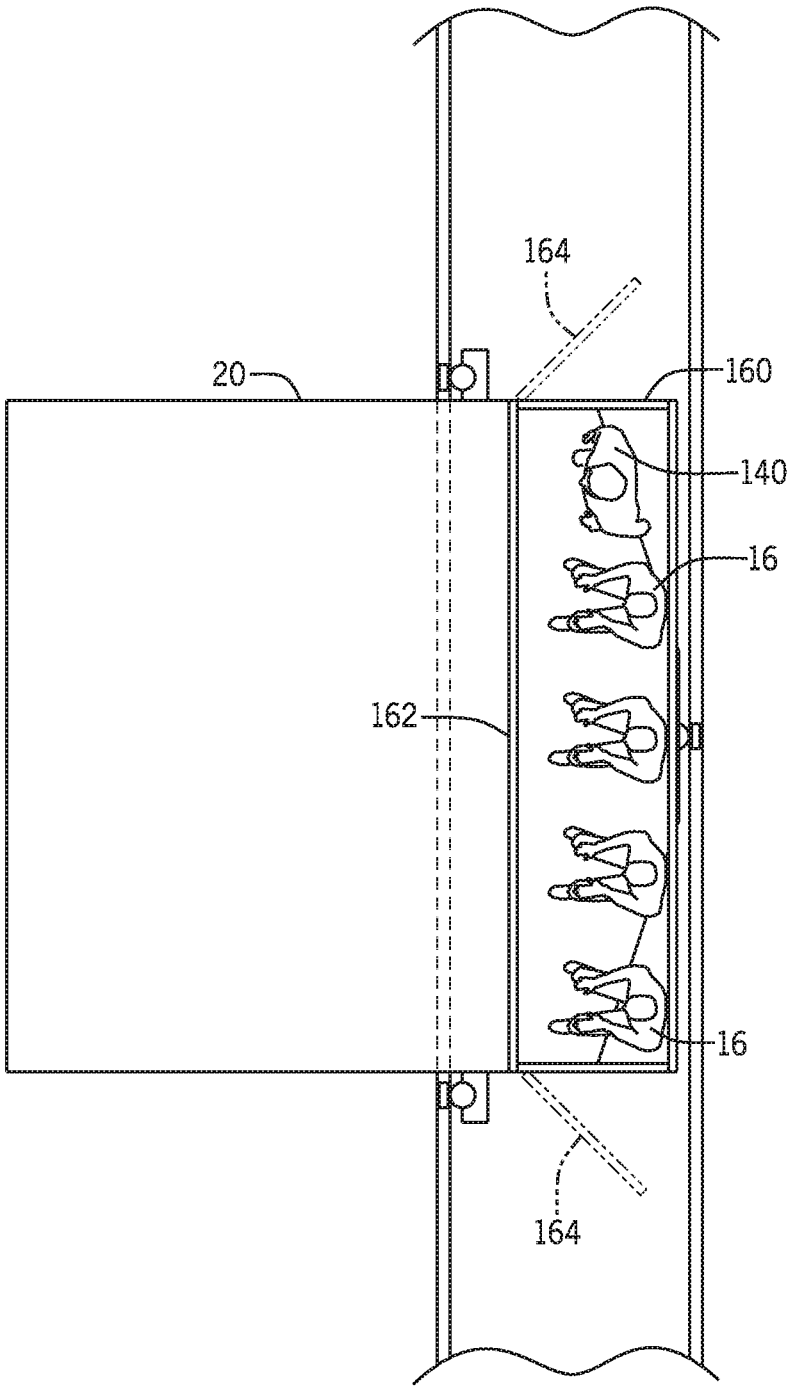
FIG. 13 is a top view of an embodiment of the evacuation platform of FIG. 12 illustrating further details of the passenger section or portion showing multiple passengers and a partition.

FIG. 13 is a top view illustrating an embodiment of the evacuation platform 20 of FIG. 12 showing the passenger section 160. More specifically, the figure shows guests 16 first in the standing position and then in a seated position (the seated position is shown offset and to the right of the passenger section 160 in the figure) which may be used during evacuation. In the depicted embodiment, a deployable partition 162 and/or deployable handrails 164 may be used to further enhance transport of the guests 16 during evacuation. It is to be noted that while a single passenger section 160 is shown, in some embodiments two or more sections may be used.

An example process for evacuation may be as follows: 1) The operator 140 or similarly trained personnel may check that the parked evacuation platform's deployable partition(s) 162 and/or handrails 164 are checked and stowed. Batteries included in the evacuation platform 20 may then be disconnected from battery chargers. The evacuation platform 20 may then be unlocked and any remote control units (RCUs) may be retrieved. 2) One or more operators 140 may then stand or sit on the evacuation platform 20 (e.g., secured via waist belts or other restraints) and operate the RCU to drive the evacuation platform 20 toward a stranded ride vehicle. Deployable partition(s) 162 and/or handrails 164 may then be rechecked for proper stowage and the evacuation platform 20 may then be positioned beneath the ride vehicle 12 so that the guests 16 feet are above the evacuation platform 20. 3) The evacuation platform 20 may then be locked into place. 4) The operator(s) 140 may then deploy the partition (s) 162 and/or handrails 164, release each of the guests' 16 restraint systems 92 (e.g., one guest at a time), instruct the guests to unload themselves from their ride seats and to step onto the evacuation platform 20, and guide the guests as they walk toward seats and/or a bench that may be included in the passenger section 160. 5) The operator(s) 140 may then assist the guests 16 into the seats and/or benches and aid in securing the guests 16, such as via restraint systems 92 (e.g., lap belts).

6) The operator(s) 140 may then stand or sit next to the guests 16 and may also be secured by restraint systems. The operator(s) 140 may then drive the evacuation platform 20 to a closest facility evacuation point. 7) At the evacuation point, the operator(s) 140 may instruct the guests 16 to unfasten their respective restraint systems 92 (operator may assist guest), to stand up, and to exit the evacuation platform 20. For example, the guests 16 may be directed to exit the ride 10 through a facility safety gate. 8) Steps 2-7 may be repeated for the evacuation of multiple ride vehicles 12 (or multiple seat-rows within one ride vehicle). 9) Once all ride vehicles 12 have been evacuated, the operator(s) 140 may then stow the deployable partitions 160 and/or handrails 164, and direct the evacuation platform 20 back into a desired docking/parking station. The evacuation platform 20 may then be reconnected to power, for example, for recharging of batteries, and the RCUs returned to their initial location.

Figure 14:
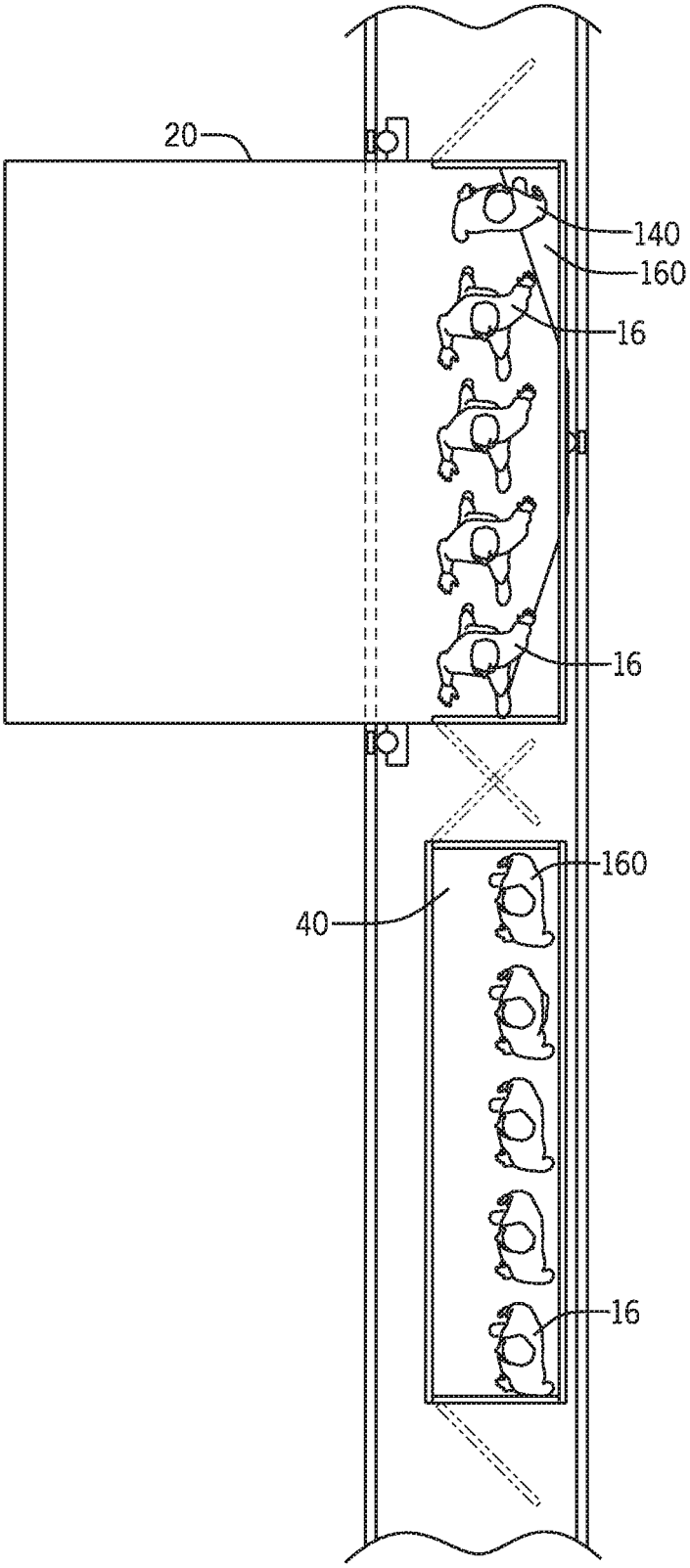
FIG. 14 is a is a top view of an embodiment of the evacuation platform of FIGS. 1 and 2 having a passenger transport section or shuttle and additionally coupled to an evacuation shuttle.

In certain embodiments, the evacuation platform 20 may include the passenger section 160 and may also be used as an intermediate transfer-platform walkway for guests to walk toward the evacuation shuttle 40, as shown in FIG. 14. More specifically FIG. 14 is a top view of the evacuation platform 20 mechanically coupled to the evacuation shuttle 40. The mechanical coupling may include a variety of vehicle-to-vehicle fasteners, including hitches, electro-magnetic couplings, tongue and groove fasteners, and so on. In the depicted embodiment, five guests 16 are shown as having entered the evacuation shuttle 40. The evacuation platform 20 may be temporarily used as an intermediate transfer walkway for operator(s) 140 and/or additional guests 16 to walk toward/onto the evacuation shuttle 40. Once the evacuation shuttle 40 is ready to depart, in certain embodiments, the evacuation shuttle 40 may depart on its own power. That is, the evacuation shuttle 40 may include one or more motors and may also be controlled by the RCU (and or the control system 22) to deliver the guests 16 to the nearest evacuation point. In other embodiments, the evacuation shuttle 40 may be towed by the evacuation platform 20. By combining the passenger section 160 with one or more evacuation shuttles 40, the techniques described herein may improve evacuation times and efficiency of passenger offloading.

Figure 15:
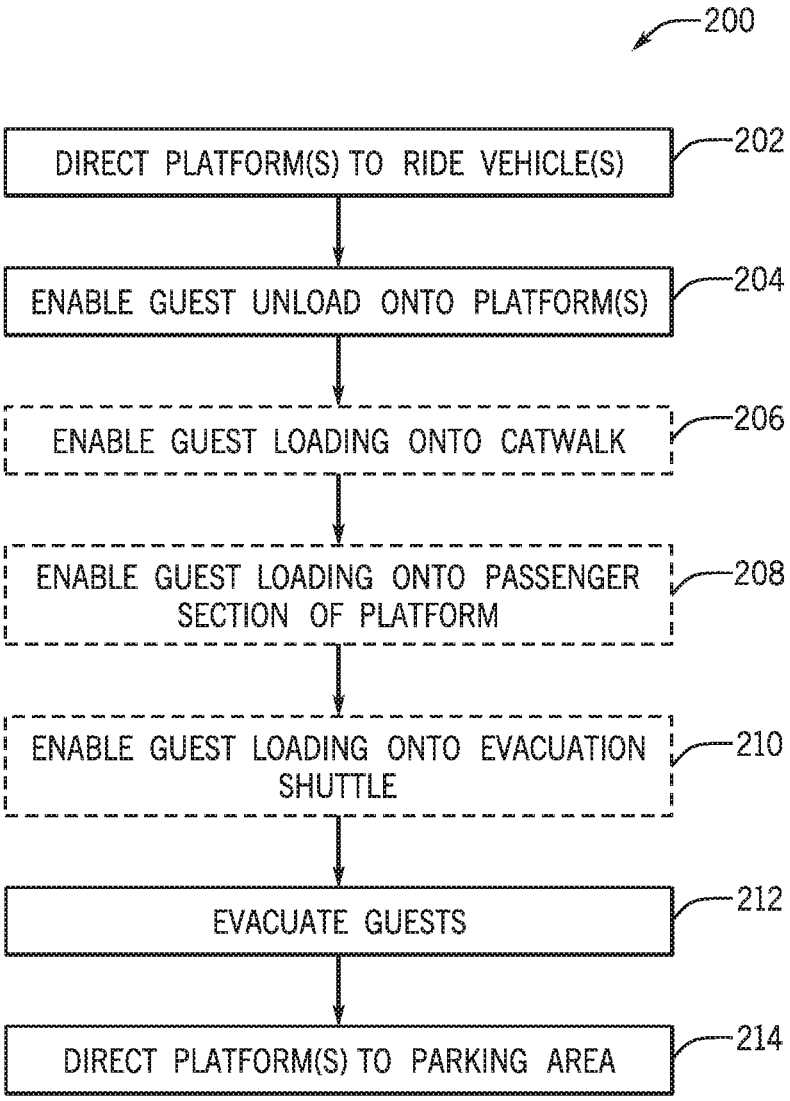
FIG. 15 is a flowchart of a process suitable for evacuating guests from the ride system of FIGS. 1 and 2.

FIG. 15 is a flow chart of an embodiment, of a process 200 suitable for evacuating guests 16 via the evacuation platform 20. The process 200 may be implemented as code or executable instructions suitable for execution by the control system 22. In the depicted embodiment, the process 200 may first direct (block 202) the evacuation platform(s) 20 to one or more ride vehicles 12. As mentioned earlier, once the evacuation platform(s) 20 are disconnected from battery chargers and unlocked, the control system 22 and/or remote control units may be used to move one or more of the evacuation platform(s) 20 to a position beneath a ride vehicle for guest evacuation.

The process 200 may then enable the guest(s) 16 to unload (block 204) onto the evacuation platform(s) 20, e.g., via operator 140 supervision and/or assistance. For example, restraint systems 92 may be unlocked (e.g., by an operator) and the guest(s) 16 may then stand up using the evacuation platform 20 for support. In some embodiments, where the ride includes the catwalk 26, the process 200 may enable (block 206) the transfer of the guest(s) 16 from the evacuation platform(s) 20 onto the catwalk 26. The process 200 may then provide for the evacuation (block 212) of the guest(s) 16 via the catwalk 26.

In embodiments that include the passenger section 160, the process 200 may enable (block 208) the loading of one or more guests 16 onto the passenger section 160. For example, the passenger section 160 may be prepared by deploying partitions 162 and/or handrails 164 before the loading of the guest(s) 16 onto the passenger section 160. The guest(s) 16 may then be secured via restraint systems 92 onto seats/benches in the passenger section 160, and the evacuation platform 20 may then be used to transport and evacuate (block 212) the guest(s) 16, for example, onto stationary facility platforms.

In embodiments that include the evacuation shuttle 40, the process 200 may enable (block 210) the transfer of the guest(s) 16 onto one or more of the evacuation shuttles 40. As mentioned above, the evacuation shuttle(s) 40 may include motors for propulsion, and thus may then be directed, e.g., via RCUs and/or the control system 22, to an evacuation point. In embodiments where the evacuation shuttle(s) 40 is towed, the towing vehicle, e.g., the evacuation platform(s) 20, may tow the evacuation shuttle(s) 40 to the evacuation point. The evacuation shuttle(s) 40 may then evacuate (block 212) the guest(s) 16, for example onto stationary facility platforms. Once the guest(s) 16 are evacuated (block 212), the process 200 may direct (block 214) the evacuation platform(s) 20 to return to designated parking areas for battery recharge and stowing of partitions 162, handrails 164, and/or maintenance scaffolds 50. The evacuation shuttle(s) 40 may be solely used for evacuation, as opposed to shuttles that may be used for other transport.

As set forth above, the ride system of the present disclosure may provide one or more technical effects useful in enhancing the guest experience during the operation of a ride system in an amusement park. For example, embodiments of the ride system may include an evacuation platform. The evacuation platform may be used as a bridge for guests to traverse from a ride vehicle onto an evacuation catwalk. The evacuation platform may further include a passenger section and may be used as an evacuation vehicle. Additionally, the evacuation platform may be used to load guests into an evacuation shuttle. Moreover, the evacuation platform may be used for maintenance of the ride, and may include one or more deployable scaffolds suitable for reaching various areas of the ride for inspection and/or for maintenance operations. The evacuation platform may follow contours of a track system, and may thus turn, bank, roll, and the like, along with the track system. The technical effects and technical problems in the specification are examples and are not limiting. It should be noted that the embodiments described in the specification may have other technical effects and can solve other technical problems.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A ride system for an amusement park, the ride system comprising:

a ride vehicle configured to carry one or more passengers; and a first evacuation platform comprising a first section configured to be moved along an evacuation guiderail and configured to be disposed underneath the ride vehicle, thereby enabling the one or more passengers to evacuate the ride vehicle by exiting onto the first section, wherein the first section, when disposed underneath the ride vehicle, is disposed underneath a vehicle rail conveying the ride vehicle, and the evacuation guiderail and the vehicle rail are disposed on opposite sides of the ride vehicle.

2. The ride system of claim 1, comprising an evacuation catwalk, wherein the evacuation catwalk is separate from the vehicle rail and is accessible to the one or more passengers from the ride vehicle by traversing the first evacuation platform.

3. The ride system of claim 2, wherein the evacuation catwalk is disposed underneath the vehicle rail.

4. The ride system of claim 2, wherein the first evacuation platform extends across the ride vehicle toward the evacuation catwalk.

5. The ride system of claim 1, comprising a first passenger shuttle configured to be loaded with the one or more passengers and to move the one or more passengers away from the ride vehicle, wherein the first passenger shuttle is accessible to the one or more passengers from the ride vehicle by traversing the first evacuation platform.

6. The ride system of claim 5, wherein the first passenger shuttle comprises a first vehicle fastener system configured to couple the first passenger shuttle with the first evacuation platform, and wherein motive power for the first passenger shuttle is provided by the first evacuation platform or by the first passenger shuttle.

7. The ride system of claim 5, comprising a second passenger shuttle comprising a second vehicle fastener system configured to couple the second passenger shuttle to the first evacuation platform, wherein motive power for the second passenger shuttle is provided by the first evacuation platform or by the second passenger shuttle.

8. The ride system of claim 1, wherein the first evacuation platform comprises a motor configured to propel the first evacuation platform to the ride vehicle.

9. The ride system of claim 1, wherein the first evacuation platform comprises at least one scaffold configured to elevate maintenance personnel to a height suitable for accessing the vehicle rail.

10. The ride system of claim 9, wherein the scaffold is configured to fold and to stow inside the first evacuation platform.

11. The ride system of claim 1, comprising a second evacuation platform comprising a second section configured to be moved and disposed underneath the ride vehicle, adjacent to the ride vehicle, or a combination thereof, thereby enabling the one or more passengers to evacuate the ride vehicle by exiting onto the first section, the second section, or a combination thereof.

12. The ride system of claim 1, wherein the first evacuation platform comprises a passenger section coupled to the first section, wherein the passenger section comprises a seat.

13. A method of evacuating one or more passengers from a ride vehicle in an amusement park ride, the method comprising:

directing, via a control system, a first evacuation platform along an evacuation guiderail during evacuation to position the first evacuation platform so that a first section of the first evacuation platform is disposed under the ride vehicle and also disposed underneath a vehicle rail conveying the ride vehicle, wherein the vehicle rail is separate from the evacuation guiderail, and the evacuation guiderail is disposed underneath the vehicle rail; and directing, via the control system, the first evacuation platform from the ride vehicle toward a parking station after the evacuation.

14. The method of claim 13, comprising directing, via the control system, the first evacuation platform to a portion of the amusement park ride undergoing maintenance activities, and deploying at least one scaffold, wherein the at least one scaffold is configured to be stowed and transported by the first evacuation platform.

15. The method of claim 13, comprising directing, via the control system, the first evacuation platform from the parking station toward the ride vehicle.

16. The method of claim 13, comprising applying, via the control system, a motive power to direct the first evacuation platform.

17. The method of claim 13, comprising charging, via a battery and power source, the first evacuation platform at the parking station.

18. An evacuation platform system, comprising:

an evacuation platform comprising:

a propulsion system configured to move the evacuation platform through an amusement park ride; and a first section configured to be moved along an evacuation guiderail and configured to be disposed underneath a ride vehicle of the amusement park ride and also disposed underneath a vehicle rail conveying the ride vehicle, thereby enabling one or more passengers to evacuate a ride vehicle included in the amusement park ride by exiting onto the first section; and the evacuation guiderail, wherein the evacuation guiderail is separate from the vehicle rail such that the ride vehicle travels in a position at least partially between the vehicle rail and the evacuation guiderail.

19. The evacuation platform system of claim 18, wherein the evacuation platform comprises a vehicle fastener system configured to couple the evacuation platform with at least one passenger shuttle.

20. The evacuation platform system of claim 18, wherein the evacuation platform comprises at least one scaffold configured to elevate maintenance personnel to a height suitable for accessing the vehicle rail.

* * * * *